United States Patent [19]

Wulf

[11] Patent Number: 5,046,919

[45] Date of Patent: Sep. 10, 1991

[54] HIGH EFFICIENCY TURBOEXPANDER

[75] Inventor: James B. Wulf, Williamsville, N.Y.

[73] Assignee: Union Carbide Industrial Gases Technology Corporation, Danbury, Conn.

[21] Appl. No.: 560,003

[22] Filed: Jul. 27, 1990

Related U.S. Application Data

[63] Continuation of Ser. No. 380,531, Jul. 17, 1989, abandoned.

[51] Int. Cl.[5] ..... F01D 1/00

[52] U.S. Cl. ..... 415/1; 415/205

[58] Field of Search ..... 415/188, 203, 204, 205, 415/208.1, 208.2, 208.3, 211.1, 181, 1

[56] References Cited

U.S. PATENT DOCUMENTS

| | | | |
|---|---|---|---|
| 2,965,287 | 12/1960 | Schoog | 230/134 |
| 3,771,925 | 11/1973 | Friberg et al. | 415/208.3 |
| 3,824,029 | 7/1974 | Fabri et al. | 415/181 |
| 3,989,406 | 11/1976 | Bliss | 415/181 |
| 4,147,467 | 4/1979 | Leicht et al. | 415/205 |
| 4,204,807 | 5/1980 | Takizama et al. | 416/188 |
| 4,280,797 | 7/1981 | Pfeil | 415/205 |
| 4,504,187 | 3/1985 | MacInnes et al. | 415/205 |
| 4,512,714 | 4/1985 | Johnson | 415/204 |
| 4,822,242 | 4/1989 | Yamazaki | 415/205 |

FOREIGN PATENT DOCUMENTS

| | | | |
|---|---|---|---|
| 0070064 | 4/1983 | Japan | 415/205 |

OTHER PUBLICATIONS

Wilson et al., The Aerodynamic and Thermodynamic Design of Cryogenic Radial Inflow Expander, ASME, Nov. 7, 1965.

Balje, Loss and Flow Path Studies on Centrifugal Compressors, Engineering for Power, Jul. 1970, pp. 287, 288, 290, 291, 300.

Wasserbauer et al., Fortran Program for Predicting Off-Design Reference of Radial Inflow Turbines, NASA Technical No. 8063, 9/75.

Balje, A Flow Model for Centrifugal Compressor Rotors, Transactions of the ASME, vol. 100, 1/78, pp. 148, 152, 153, 158.

Balje, Turbomachines, John Wiley & Sons, N.Y. 1981, pp. 150-153, 375-377, 389, 390.

Kun et al., High Efficiency Expansion Turbines, in Air Separation and Liquefaction Plants, CIESC, 10/85 Beijing, China.

Turbine Design and Application, NASA 79-185105.

Johnson et al., Aerodynamic Design of Axial-Flow Compressors-1965, pp. 3-6.

Wilson-The Design of High-Efficiency Turbomachinery and Gas Turbines-1984.

Department of Energy-R & D for Improved Efficiency Small Steam Turbines-2/28/83.

*Primary Examiner*—Edward K. Look

*Assistant Examiner*—Hoang Nguyen

*Attorney, Agent, or Firm*—Stanley Ktorides; Peter Kent

[57] ABSTRACT

A turboexpander with improved efficiency wherein fluid is introduced into the rotatable assembly at a negative incidence angle and expanded within the rotatable assembly along a pressure balanced flow path.

9 Claims, 2 Drawing Sheets

HIGH EFFICIENCY TURBOEXPANDER

This application is a continuation of prior U.S. application Ser. No. 380,531, filed July 17, 1989, now abandoned.

TECHNICAL FIELD

This invention relates generally to the field of turboexpansion whereby fluid is expanded to produce useful work.

BACKGROUND ART

A high pressure fluid is often expanded, i.e. reduced in pressure, through a turbine to extract useful energy from the fluid and thus to produce work. The high pressure fluid enters the turbine and passes through a plurality of passages defined by turbine blades which are mounted on an impeller hub which in turn is mounted on a shaft. The fluid enters the blade passages and causes rotation of the impeller and ultimately leads to the recovery of energy and to the production of work from the spinning shaft.

It is desirable to operate the expansion turbine with as high an efficiency as possible. Since turboexpanders generally handle large volumes of fluid, even a small increase in turbine efficiency will have a significant impact on operating results.

Accordingly, it is an object of this invention to provide an improved method for operating a turboexpander to achieve increased efficiency over that attainable with known operating methods.

It is another object of this invention to provide a high efficiency turboexpander having increased efficiency over that attainable with known turboexpanders.

SUMMARY OF THE INVENTION

The above and other objects which will become apparent to one skilled in the art upon a reading of this disclosure are attained by the present invention one aspect of which is:

A method for operating a turboexpander having a rotatable assembly comprising a shaft, an impeller hub mounted on the shaft, and a plurality of blades on the impeller hub to form a plurality of fluid flow paths, each fluid flow path defined by the impeller hub surface and two adjacent blades, said method comprising:

(A) passing fluid into a fluid flow path at an angle directed toward the leading edge of the trailing blade of the two adjacent blades forming the fluid flow path; and (B) passing the fluid through the fluid flow path while maintaining the pressure normal to the mean streamline of the fluid in the meridional plane between the impeller hub surface and the shroud surface substantially constant.

Another aspect of the present invention is:

A turboexpander having a rotatable assembly comprising a shaft, an impeller hub mounted on the shaft, and a plurality of blades on the impeller hub to form a plurality of fluid flow channels, each fluid flow channel defined by the impeller hub surface and two adjacent blades, characterized by:

(A) means to provide fluid into a fluid flow channel at an angle directed toward the leading edge of the trailing blade of the two adjacent blades forming the fluid flow channel; and (B) the impeller hub and the two adjacent blade surfaces forming the fluid flow channel being contoured so that as a fluid element moves through the fluid flow channel along the mean streamline, the sum of the forces on the element normal to the streamline in the meridional plane is about zero.

As used herein, the term "turboexpander efficiency" means the ratio of the actual to the ideal enthalpy difference between the inlet and the outlet conditions of the turboexpander.

As used herein, the term "mean streamline" means the fluid flow path line which connects the midpoints of the fluid flow channel along the fluid flow path.

As used herein, the term "meridional plane" means any plane that contains a point on the mean streamline of the fluid flow and the centerline of the impeller shaft.

As used herein, the term "substantially constant" means within plus or minus 10 percent, preferably within plus or minus 5 percent.

DETAILED DESCRIPTION

The invention will be described in detail with reference to the Drawings.

Figure 1:
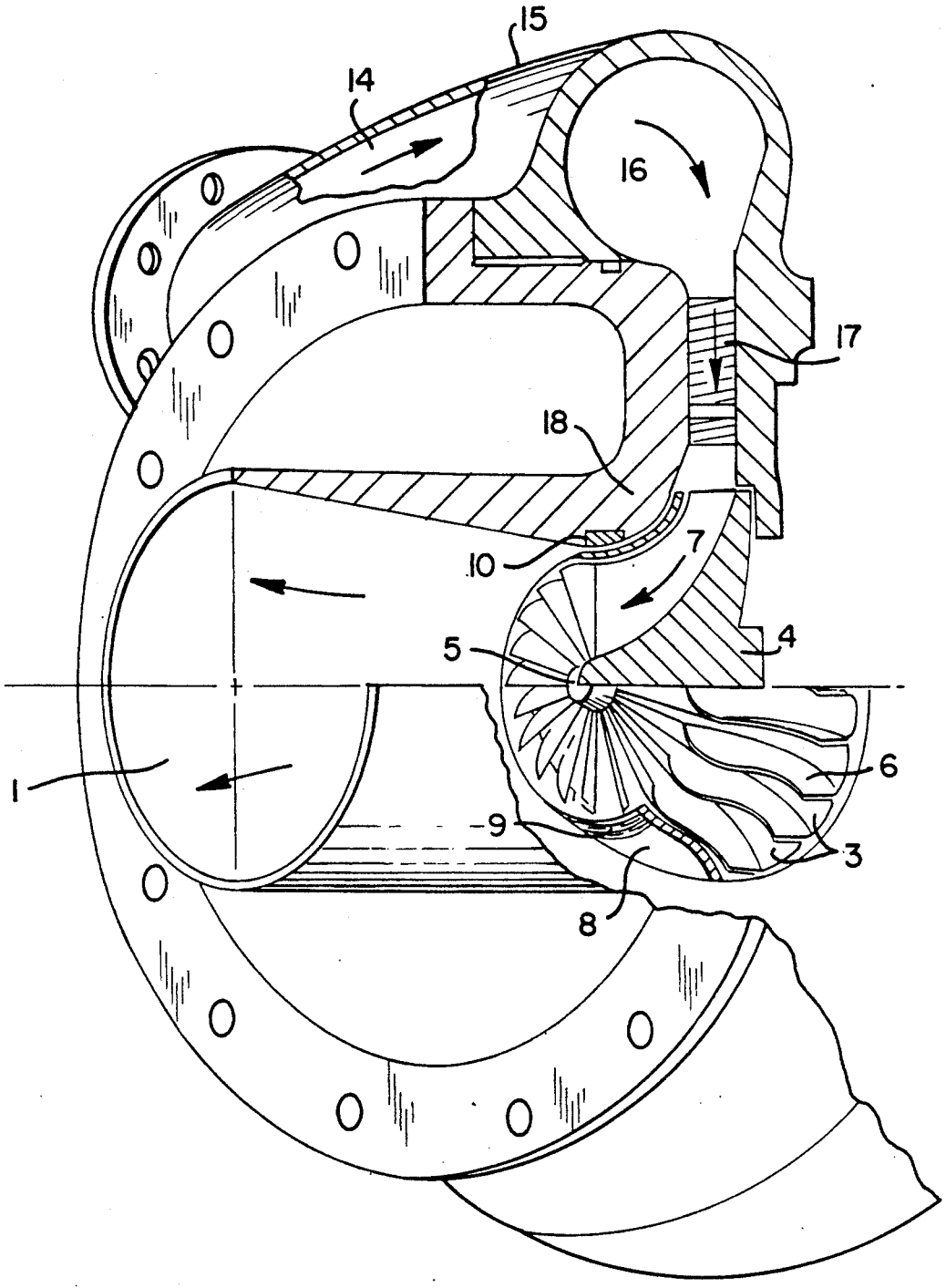
FIG. 1 is a simplified illustration in cross-section showing a turboexpander which may be used to carry out this invention.

Referring now to FIG. 1, fluid 14, such as nitrogen gas, at an elevated pressure is passed into and through turboexpander 15 and into the rotatable assembly. The fluid inlet chamber 16 may be a volute or plenum that directs the fluid to inlet nozzles 17. The rotatable assembly comprises shaft 5 and impeller hub 4 mounted on shaft 5. A plurality of curved blades 6 are mounted on impeller hub 4 and, in this arrangement, shroud 8 covers the blades. The arrangement results in a plurality of fluid flow paths 3 defined by the impeller hub surface, the shroud inner surface and two adjacent blades. Shrouded impellers, as illustrated in FIG. 1, typically utilize a labyrinth seal 9 with seal face member 10 to prevent fluid bypass of the rotating assembly. Non-shrouded or open impellers can be utilized with this invention and would utilize blade contours closely fitted to the stationary housing 18. In the case of non-shrouded or open impellers, the stationary housing surface would be equivalent to the shroud surface and thus the plurality of fluid flow paths would be defined by the impeller hub surface, the housing inner surface and two adjacent blades.

Fluid passes through the curved flow paths as illustrated by arrow 7. As the fluid passes through the flow paths the volume along the flow path increases and the fluid is expanded. In the course of this expansion the fluid pressure is reduced by momentum transfer onto blades 6. This energy exchange causes the rotatable assembly to rotate. The shaft is connected to means which uses energy such as compressor or generator. In this way useful work is transferred from turboexpander flow to, for example, compressor operation. The expanded fluid is passed out of turboexpander 15 as illustrated by arrows 1. Typically the fluid is expanded from a pressure within the range of about 300 to 800 psia to a pressure within the range of about 15 to 100 psia.

The fluid is passed through the flow passages in a pressure balanced manner wherein the pressure normal to the mean streamline in the meridional plane between the impeller hub surface and the shroud surface is kept substantially constant. One way of maintaining the pressure normal to the mean streamline substantially constant is to provide a turboexpander having flow passage contours which balance the forces on a fluid element including the centrifugal force due to wheel rotation, the centrifugal force due to the curved trajectory of the element, the coriolis force due to the movement in a moving coordinate system and the force due to changes in momentum such that the sum of these forces on a fluid element is about zero as it moves along a pressure balanced flow mean streamline in the meridional plane. A flow path where the forces on a fluid element are balanced as described above is commonly referred to as a pressure balanced flow path. Those skilled in the art of turboexpansion are familiar with the concept of a pressure balanced flow path and the conditions under which pressure balanced flow is attained. A particularly useful and comprehensive text describing turbomachinery in general, and pressure balanced flow paths in particular, is *Turbomachines*, O. E. Balje, John Wiley & Sons, New York 1981, particularly chapter 6.

The invention comprises the discovery that if high pressure fluid is introduced into the fluid flow paths at a defined negative angle and then passed through the fluid flow paths while maintaining the fluid pressure normal to the mean streamline in the meridional plane substantially constant, an unexpected increase in turboexpander efficiency is attained.

Figure 2:
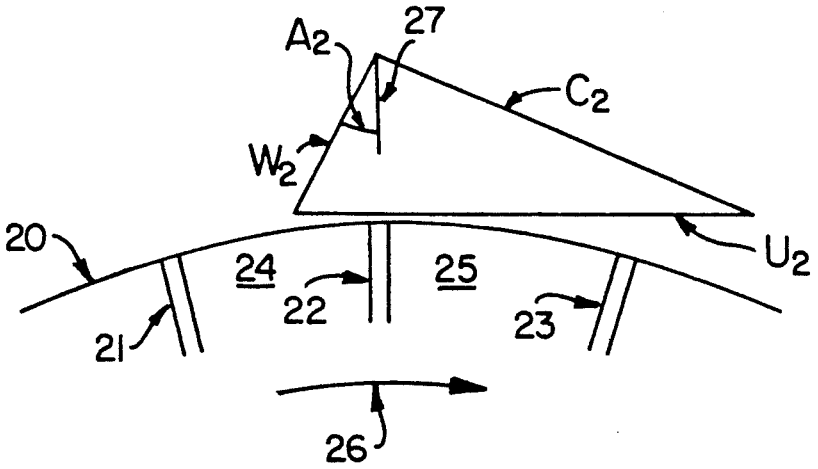
FIG. 2 is an inlet velocity diagram illustrating the negative incidence of this invention.

This defined negative angle will now be described with reference to FIG. 2. In FIG. 2 there is shown a simplified diagram of an impeller wheel 20 having blades 21, 22 and 23. Adjacent blades 21 and 22 form the sidewalls of flow path 24 and adjacent blades 22 and 23 form the sidewalls of flow path 25. Assuming impeller wheel 20 rotates in a clockwise direction 26, blade 23 is the leading blade and blade 22 is the trailing blade of flow path or flow channel 25. Similarly blade 22 is the leading blade and blade 21 is the trailing blade of flow path or flow channel 24. The right side of each blade is the leading edge and the left side of each blade is the trailing edge.

Elevated pressure fluid is passed into the rotatable assembly at a certain absolute velocity illustrated in FIG. 2 by the vector $C_2$. This vector $C_2$ can be resolved as shown in FIG. 2 into the vectors $W_2$ and $U_2$. $U_2$ represents the tangential impeller velocity at the point where the fluid enters the rotatable assembly. $W_2$ represents the fluid velocity relative to the impeller surfaces. Vector $W_2$ forms an angle $A_2$ with the line 27 which represents the theoretical extension of blade 22. This angle $A_2$, known as the relative flow angle, represents the angle between the fluid flow and the blades.

In the practice of this invention, at the design point elevated pressure fluid is introduced into the rotatable assembly of a turboexpander with an absolute velocity such that the angle between the fluid flow and the blades is negative. In other words the elevated pressure fluid flowing into a flow path does so at an angle directed toward the leading edge of the trailing blade of the two adjacent blades forming that flow path. Preferably this incidence angle is within the range of from −10 to −40 degrees.

The desired negative incidence inlet flow is attained by adjusting the inlet nozzles 17 shown in FIG. 1. It should be noted that the invention is preferably utilized with substantially no fluid swirl at the outlet of the turbine impeller. This means that the blade exit angle must be such that the fluid exiting into diffuser 1 has essentially zero tangential velocity.

The following Example and Comparative Examples are presented to further illustrate the invention or to demonstrate the improved efficiency attainable by use of the method of this invention. They are not intended to be limiting.

EXAMPLE

Gaseous nitrogen at a pressure of from about 500 to 650 pounds per square inch absolute (psia) was expanded by passage through a turboexpander of this invention to a pressure of from about 70 to 90 psia. The expansion caused the rotatable assembly of the turboexpander to rotate at about 23,000 revolutions per minute (rpm). The fluid passed through each flow path while the pressure normal to the mean streamline in the meridional plane of that flow path was substantially constant and the fluid exited from the impeller with substantially zero swirl. The fluid was passed into the rotatable assembly at an absolute velocity and direction which caused the fluid to have an incidence angle of about −15 degrees. The turboexpander was operated until steady state conditions were reached and the efficiency was measured.

COMPARATIVE EXAMPLE 1

For comparative purposes a procedure similar to that described in the Example was carried out except that the turboexpander design and the fluid absolute velocity and direction resulted in an incidence angle of about 0 degrees. The measured efficiency of the turboexpander was 1.7 percentage points less than that achieved in the Example.

COMPARATIVE EXAMPLE 2

For comparative purposes a procedure similar to that described in the Example was carried out except that the turboexpander design and the fluid absolute velocity and direction resulted in an incidence angle of about +11 degrees. The measured efficiency of the turboexpander was 2.5 percentage points less than that achieved in the Example.

It is thus demonstrated that the method and apparatus of this invention enables an increase in turboexpander efficiency over that attainable when the invention is not employed.

It is surprising that such an efficiency increase is attained. Heretofore it has been the conventional thinking in the turboexpander art that when fluid is expanded through a turboexpander in a pressure balanced flow path, the fluid angle of incidence with the blades should be about 0 degrees. This is because such a zero incidence injection would cause the fluid to become aligned with the blades within the flow channels in the shortest possible time thus reducing swirls, eddy currents and other fluid flow behavior within the flow channels which would detract from turboexpander efficiency.

While not wishing to be held to any theory, applicant believes that the unexpected increase in turboexpander efficiency attained when the fluid is passed into the flow paths at a negative incidence angle and expanded through the flow paths in a pressure balanced manner may be explained as follows.

Since the blades have a defined or non-zero thickness the fluid passing into the rotatable assembly is confined in volume by the blade volume. The fluid flow is thus disturbed by this contraction caused by the leading blade thickness. This disturbance results in an efficiency penalty. However, if the fluid is introduced into the rotatable assembly at a negative incidence angle, i.e. directed toward the leading edge of the trailing blade, the fluid flow is divided, the disturbance discussed above is reduced, and the fluid most closely follows the path intended by the designer.

Now by the use of this invention one can carry out turboexpansion with an efficiency higher than that heretofore attainable. While the invention has been described in detail with reference to a certain embodiment it will be understood that there are other embodiments of this invention within the spirit and scope of the claims.

What is claimed is:

1. A method for operating a turboexpander having a rotatable assembly comprising a shaft, an impeller hub mounted on the shaft, and a plurality of blades on the impeller hub to form a plurality of fluid flow paths, each fluid flow path defined by the impeller hub surface and two adjacent blades, said method comprising:

(A) passing fluid into a fluid flow path at the design point of the turboexpander at an angle directed toward the leading edge of the trailing blade of the two adjacent blades forming the fluid flow path wherein the angle is within the range of from about −10 to −40 degrees wherein the negative sign of the angle denotes the direction from orthogonal opposite to that in which the rotatable assembly rotates; and (B) passing the fluid through the fluid flow path while maintaining the pressure normal to the means streamline of the fluid in the meridional plane between the impeller surface and the shroud surface substantially constant.

2. The method of claim 1 wherein the fluid is a gas.

3. The method of claim 2 wherein the gas is nitrogen.

4. The method of claim 1 wherein the rotatable assembly is within a stationary housing and each fluid flow path is also defined by the housing surface.

5. The method of claim 1 wherein a shroud covers the blades and each fluid flow path is also defined by the shroud surface.

6. The method of claim 1 further comprising passing the fluid out from the fluid flow path having substantially zero tangential velocity.

7. A turboexpander having a rotatable assembly comprising a shaft, an impeller hub mounted on the shaft, and a plurality of blades on the impeller hub to form a plurality of fluid flow channels, each fluid flow channel defined by the impeller hub surface and two adjacent blades, characterized by:

(A) means to provide fluid into a fluid flow channel at the design point of the turboexpander at an angle directed toward the leading edge of the trailing blade of the two adjacent blades forming the fluid flow channel wherein the angle is within the range of from about −10 to −40 degrees wherein the negative sign of the angle denotes the direction from orthogonal opposite to that in which the rotatable assembly rotates; and (B) the impeller hub and the two adjacent blade surfaces forming the fluid flow channel being contoured so that as a fluid element moves through the fluid flow channel along the mean streamline, the sum of the forces on the element normal to the streamline in the meridional plane is about zero.

8. The turboexpander of claim 7 wherein the rotatable assembly is within a stationary housing, each fluid flow channel is also defined by the housing surface, and the housing surface is also contoured to achieve the defined force sum.

9. The turboexpander of claim 7 further comprising a shroud covering the blades wherein each fluid flow channel is also defined by the shroud surface, and the shroud surface is also contoured the achieve the defined force sum.

* * * * *